US008066082B2

(12) United States Patent
Tatsuno

(10) Patent No.: US 8,066,082 B2
(45) Date of Patent: Nov. 29, 2011

(54) AIR DRIVER DEVICE

(75) Inventor: Koji Tatsuno, Osaka (JP)

(73) Assignee: Uryu Seisaku Ltd., Osaka (JP)

( * ) Notice: Subject to any disclaimer, the term of this patent is extended or adjusted under 35 U.S.C. 154(b) by 1064 days.

(21) Appl. No.: 11/698,949

(22) Filed: Jan. 29, 2007

(65) Prior Publication Data

US 2007/0193758 A1 Aug. 23, 2007

(30) Foreign Application Priority Data

Feb. 17, 2006 (JP) ..... 2006-040775

(51) Int. Cl.
*B25D 15/00* (2006.01)

(52) U.S. Cl. ..... 173/178; 173/93.5; 173/177; 173/218; 173/176; 173/169; 192/150; 192/48.7

(58) Field of Classification Search ..... 173/93.5, 173/177, 218, 176, 169; 192/150, 48.7
See application file for complete search history.

(56) References Cited

U.S. PATENT DOCUMENTS 3,174,606 A * 3/1965 Hornschuch et al. ..... 192/150
3,612,236 A * 10/1971 Fernstrom et al. ..... 192/56.56
4,418,764 A * 12/1983 Mizobe ..... 173/177
4,576,270 A * 3/1986 Baltz et al. ..... 192/150
4,635,731 A * 1/1987 Wallace et al. ..... 173/177
4,844,177 A * 7/1989 Robinson et al. ..... 173/178
5,060,771 A * 10/1991 Robinson ..... 477/178
5,060,772 A * 10/1991 Anders et al. ..... 477/178
5,080,181 A * 1/1992 Tatsuno ..... 173/93.5
5,092,410 A * 3/1992 Wallace et al. ..... 173/93.5
5,217,079 A * 6/1993 Kettner et al. ..... 173/177
5,310,010 A * 5/1994 Lo ..... 173/178
5,544,710 A * 8/1996 Groshans et al. ..... 173/176
6,179,063 B1 * 1/2001 Borries et al. ..... 173/93.5
7,237,622 B2 * 7/2007 Liao ..... 173/104

* cited by examiner

*Primary Examiner* — Rinaldi I. Rada
*Assistant Examiner* — Michelle Lopez
(74) *Attorney, Agent, or Firm* — Wenderoth, Lind & Ponack, L.L.P.

(57) ABSTRACT

An air driver device having a simple construction, being of a compact size, and having excellent durability. The air driver device is designed to shut off a supply of compressed air to an air motor, by means of a tightening torque control mechanism and a shut-off valve mechanism, in a case where the tightening torque reaches the set torque value. The air device is designed to tighten screw members at a prescribed tightening force, wherein the tightening torque control mechanism is composed of (i) a clutch unit, (ii) a driving piston on the back face of which is formed one clutch plate, so that clutch plates of the clutch unit may move by making rotational differential motions in a case where the tightening torque reaches the set torque value, (iii) a cylinder for storing this driving piston, (iv) a check valve for operating the shut-off valve mechanism, in linkage with the driving piston through an oil charged in the cylinder, and (v) a torque control member for regulating the set torque value.

3 Claims, 13 Drawing Sheets

FIG. 13 (a) (PRIOR ART)
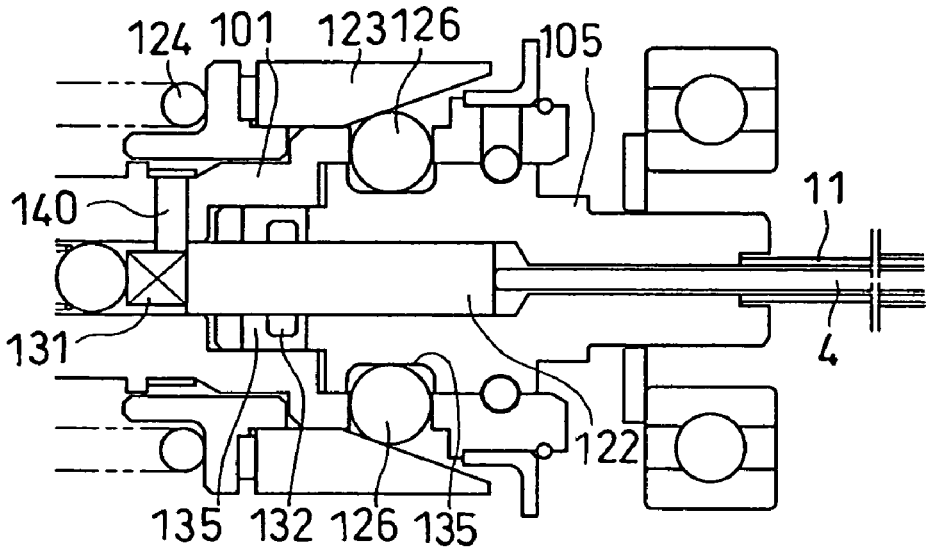
FIG. 13 (b) (PRIOR ART)
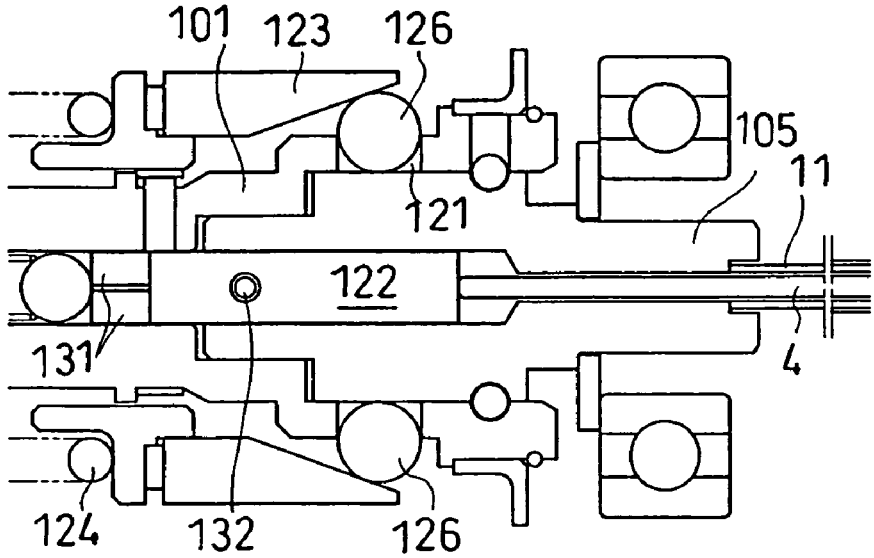

FIG. 14 (a 1) (PRIOR ART)
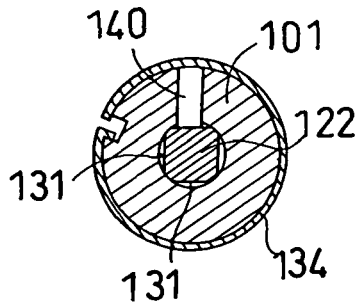
FIG. 14 (a 2) (PRIOR ART)
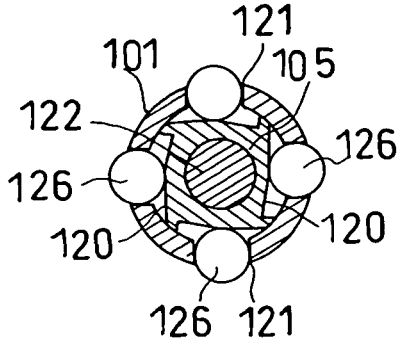
FIG. 14 (b 1) (PRIOR ART)
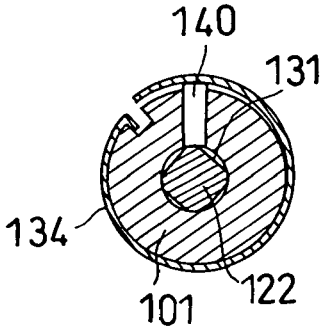
FIG. 14 (b 2) (PRIOR ART)
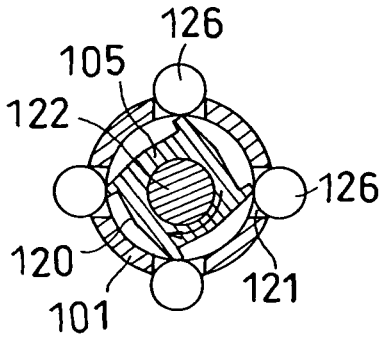

AIR DRIVER DEVICE

BACKGROUND OF THE INVENTION

1. Field of the Invention

The present invention concerns an air driver device used for tightening screw members such as screws, bolts & nuts, etc., more specifically an air driver device for tightening screw members at a prescribed tightening force.

2. Background of the Related Art

Conventionally, an air driver device is used for tightening screw members such as screws, bolts & nuts, etc., and is put to practical use by tightening screw members at a prescribed tightening force, by shutting off a supply of compressed air to an air motor, by means of a tightening torque control mechanism and a shut-off valve mechanism, in a case where the tightening torque has reached a set torque value (refer to JP 58-34265 B, JP 2004-106146 A).

This conventional air driver device comprises an operating shaft for turning an air motor by opening the shut-off valve of a shut-off valve mechanism disposed in the air supply channel by inwardly pushing a spindle, and is designed in such a way as to connect a cam turned by the air motor with the spindle, by means of a torque control mechanism which makes a differential rotational motion, relatively, in a case where the tightening torque has reached the set torque value, so as to stop the air motor by closing the shut-off valve of the shut-off valve mechanism by moving the push rod with a differential rotational motion of the torque control mechanism.

To be more concrete, as a torque control mechanism, this air driver device is designed to put balls 126, which are fit and supported in ball fitting holes 121 drilled in the spindle 101, in contact with the respective ball supporting faces 120 of the cam 105, and slidably fit, on the outer circumference of the ball fitting & supporting portion of the spindle 101, a cam ring 123 tapered on the face to be in contact with the balls 126, in the axial direction, to transmit the rotational driving force from the cam 105 turning with the air motor 103, through the balls 126, to the spindle 101, as shown in FIG. 13~FIG. 14. On the other hand, this air driver device adopts a construction in which, when the tightening torque reaches the set torque value, the balls 126 are pushed outwardly, in the direction of the outer circumference, from the ball supporting faces 120 of the cam 105 in order to stop the transmission of torque between the cam 105 and the spindle 101. In the case where the balls 126 are pushed upwardly in the direction of outer circumference, from the ball supporting faces 120 of the cam 105, a differential motion in the direction of rotation is produced between the cam 105 and the spindle 101, producing a difference of rotation between the two. This causes a pilot pin 122, which turns together with the cam 105, to turn relatively against the spindle 101, to push up a lock pin 140 with the projected side of its chamfered step portion 131, release the engagement between the pilot pin 122 and the chamfered step portion 131 by the lock pin 140 and enable movement of the pilot pin 122 and the push rod 104, so as to stop the air motor by closing the shut-off valve 110 of the shut-off valve mechanism.

As explained above, the above-mentioned conventional air driver device, which uses, as a torque control mechanism, a mechanism of complicated structure composed of constituent members such as a cam 105, balls 126, a cam ring 123, etc., is difficult to realize in compact size, and also presents a problem that the constituent members are easily worn and lack durability.

BRIEF SUMMARY OF THE INVENTION

In view of the problems of the above-described conventional air driver device, the objective of the present invention is to provide an air driver device of simple construction that is compact in size and has excellent durability.

To achieve this objective, an air driver device according to the present invention is an air driver device comprising an air driver, and designed to shut off the supply of compressed air to the air motor, by means of a tightening torque control mechanism and a shut-off valve mechanism, in a case where the tightening torque has reached a set torque value, and tighten screw members at a prescribed tightening force.

The tightening torque control mechanism includes a clutch unit, a driving piston on the back face of, which is formed of one clutch plate so that clutch plates of said clutch unit may move by making rotational differential motions, relatively, in a case where the tightening torque has reached the set torque value, a cylinder for storing the driving piston, a check valve for operating said shut-off valve mechanism, in linkage with said driving piston through an oil charged in the cylinder, and a torque control member for regulating the set torque value.

In this case, it is possible to dispose, on said check valve, an inertial force absorbing piston that is movable in the axial direction of the check valve, so that the urging force of the spring constituting the torque control member may act, through the inertial force absorbing piston, on the check valve, and enable to temporarily store the oil in the auxiliary cylinder storing the inertial force absorbing piston.

According to the air driver device of the present invention, by constructing the tightening torque control mechanism with a clutch unit, a driving piston on the back face, on which is formed, one of the clutch plates so that the clutch plates of said clutch unit may move by making relative rotational differential motions in a case where the tightening torque has reached the set torque value, a cylinder for storing the driving piston, a check valve for operating said shut-off valve mechanism, in linkage with said driving piston through an oil charged in the cylinder, and a torque control member for regulating the set torque value. Therefore, it becomes possible to realize a device of a simple structure and a compact size, and to provide an air driver device having excellent durability, and having only a small number of easily worn constituent members, by interposing an oil charged in the cylinder in the working mechanism.

Furthermore, by disposing, on said check valve, an inertial force absorbing piston, which is movable in the axial direction of the check valve, so that the urging force of the spring constituting the torque control member may act, through the inertial force absorbing piston, on the check valve, and temporarily store oil in the auxiliary cylinder storing the inertial force absorbing piston, it becomes possible to perform engagement and disengagement of the clutch unit smoothly, and prevent any excessive tightening of the screw members due to the inertial force produced at the time of working the shut-off valve mechanism. This enables accurate tightening with a prescribed tightening force.

BRIEF DESCRIPTION OF THE DRAWINGS

FIG. 13 (*a*) is a sectional view before starting a conventional air driver device, and FIG. 13 (*b*) is a sectional view during a shut-off.

FIG. 14 (*a*1) and FIG. 14 (*a*2) are cross-sectional views of FIG. 13 (*a*), and FIG. 14 (*b*1) and FIG. 14 (*b*2) are cross-sectional views of FIG. 13 (*b*).

DETAILED DESCRIPTION OF THE INVENTION

Figure 1:
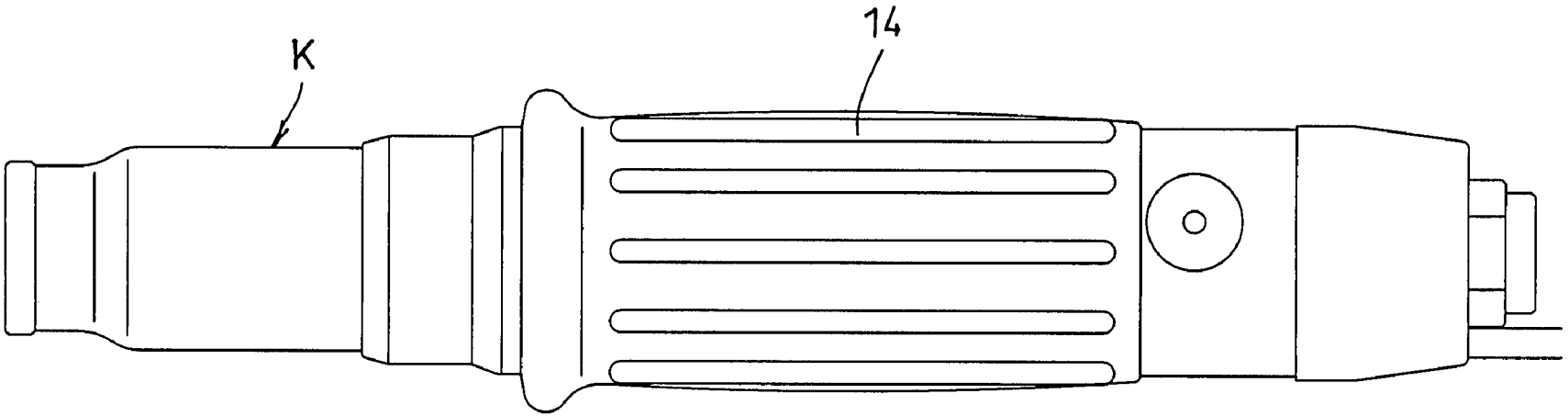
FIG. 1 is a front elevation showing an embodiment of the air driver device according to the present invention.

An embodiment of the air driver device according to the present invention will be explained below, with reference to drawings.

FIG. 1 to FIG. 12 indicate an embodiment of the air driver device according to the present invention.

This air driver device comprises a push rod 4 for turning an air motor 3 by opening a valve 2 disposed in an air supply channel 8 by pushing in a spindle 1, and is designed in such a way as to connect a speed-reducing drive unit 5 turned by the air motor 3 with the spindle 1, by means of a torque control mechanism 6, so as to shut off the supply of compressed air to the air motor 3, by means of the torque control mechanism 6 and a shut-off valve mechanism 7, and tighten screw members at a prescribed tightening force, in a case where the tightening torque has reached a set torque value.

Figure 2:
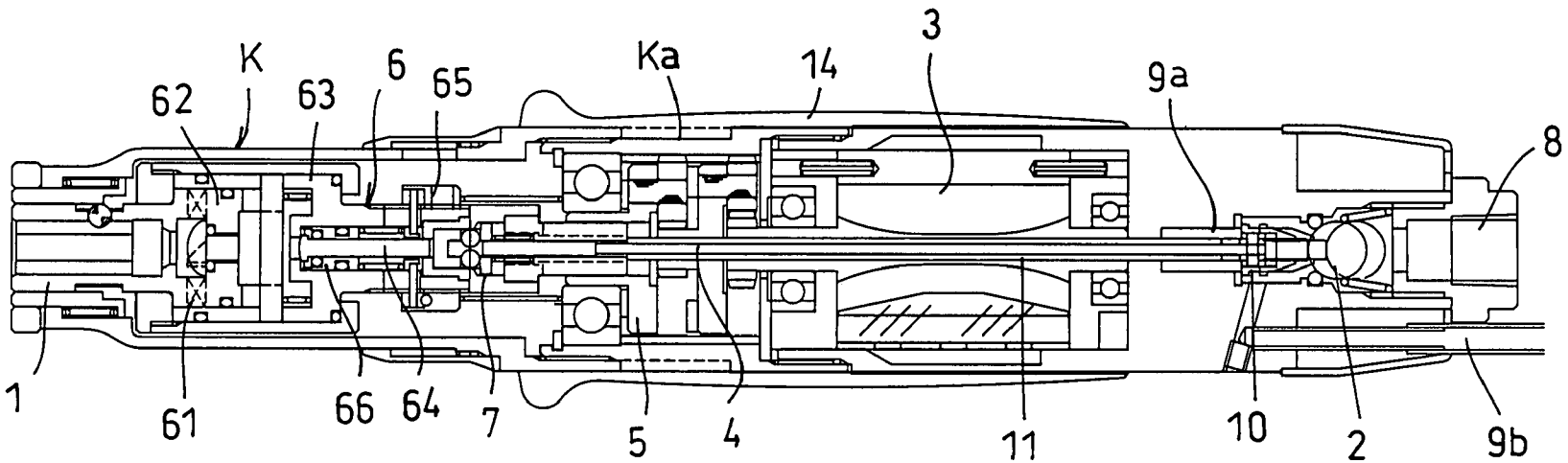
FIG. 2 is a sectional view of the front elevation of the air driver device according to the present invention.
Figure 3:
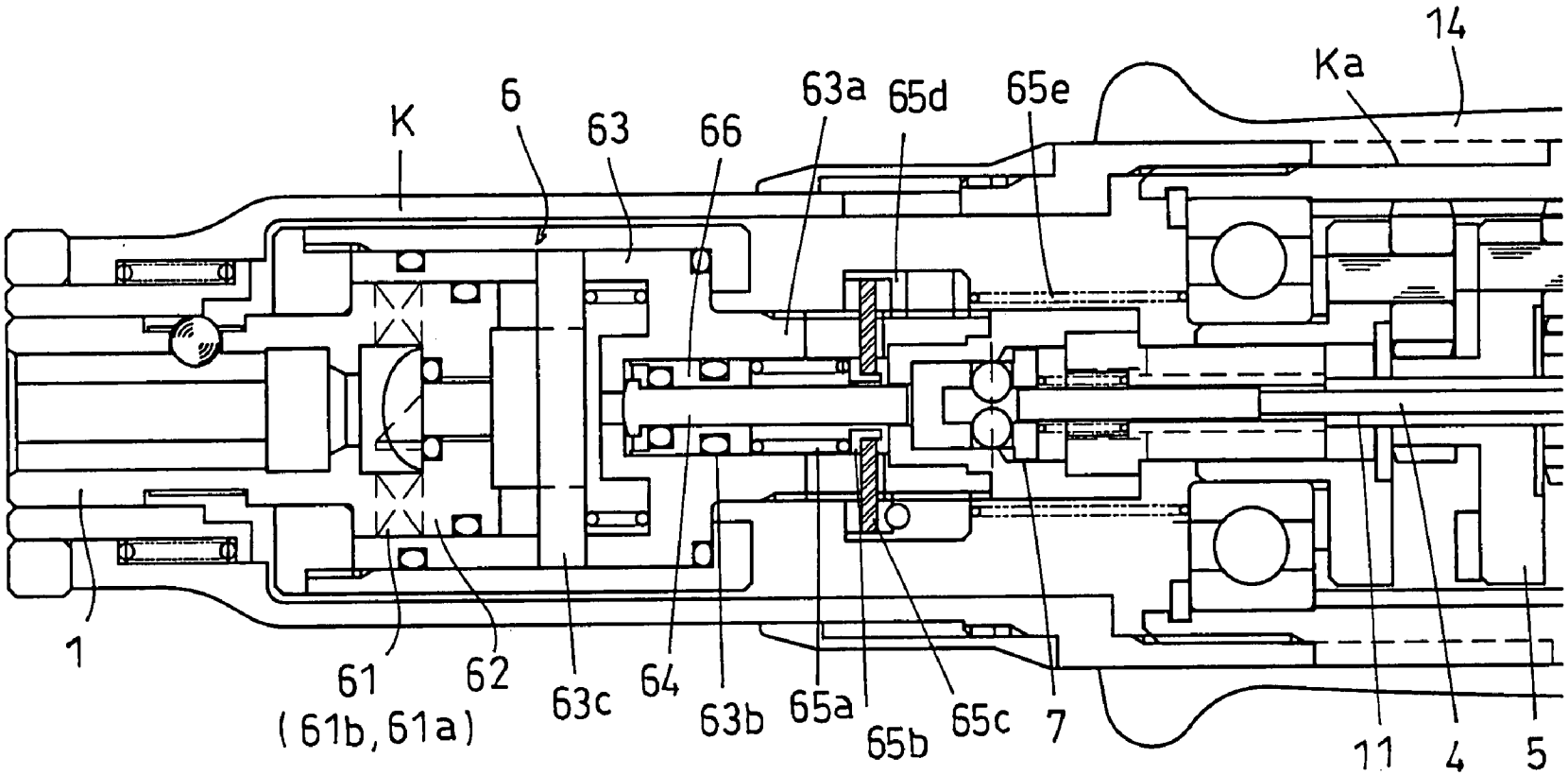
FIG. 3 is a partial expanded sectional view of the front elevation of the air driver device according to the present invention.
Figure 4:
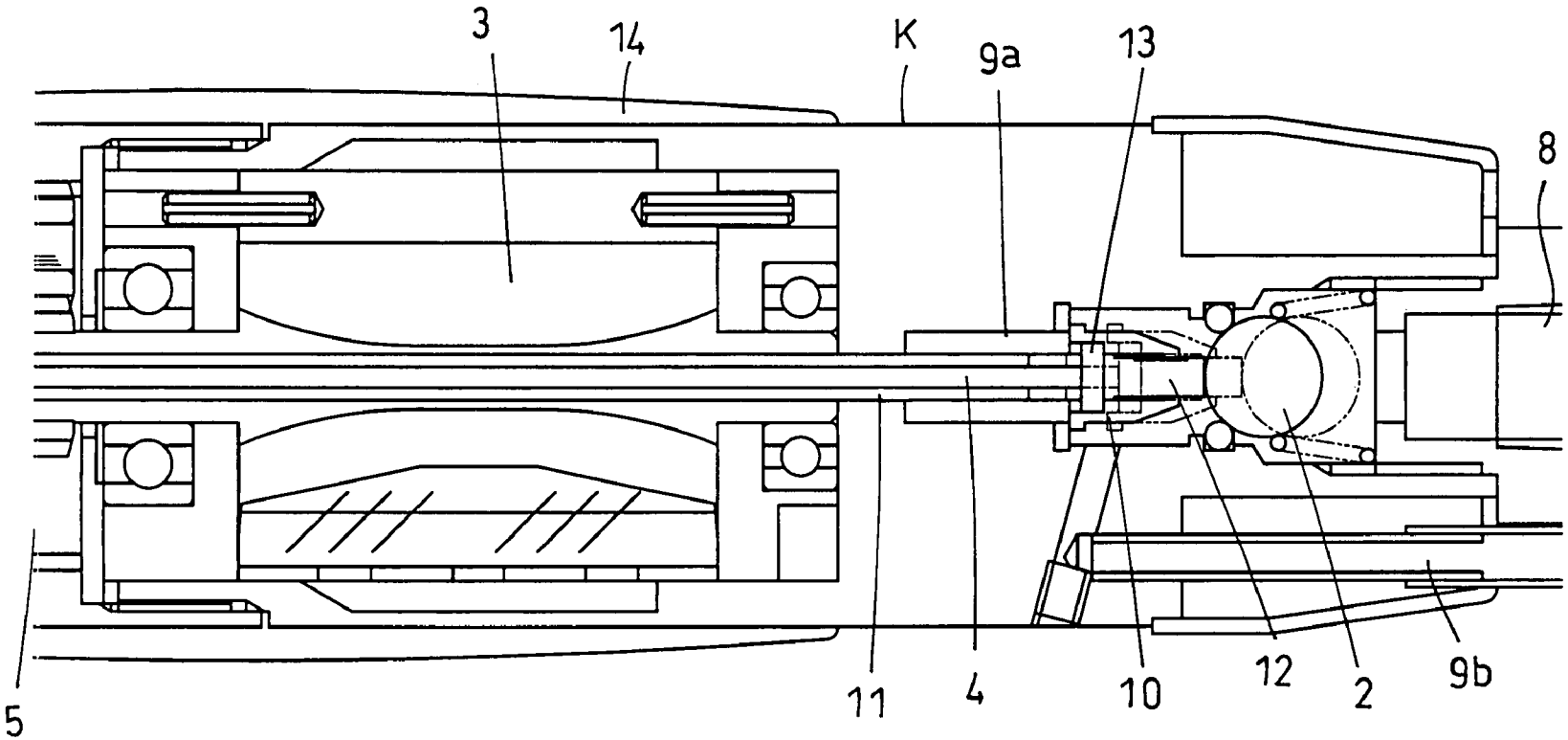
FIG. 4 is a partial expanded sectional view of the front elevation of the air driver device according to the present invention.
Figure 5:
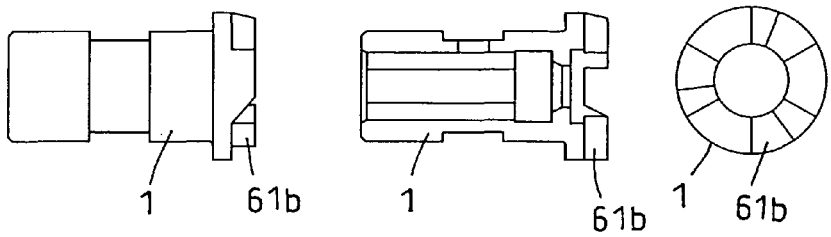
FIG. 5 (*a*) is a plan view of the spindle, FIG. 5 (*b*) is a front elevation, and FIG. 5 (*c*) is a right side view.
Figure 6:
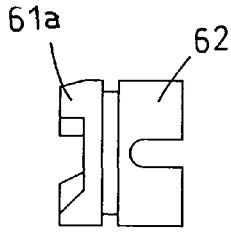
FIG. 6 (*a*) is a plan view of the driving piston, FIG. 6 (*b*) is a front elevation, FIG. 6 (*c*) is a left side view, and FIG. 6 (*d*) is a front sectional view.
Figure 6:
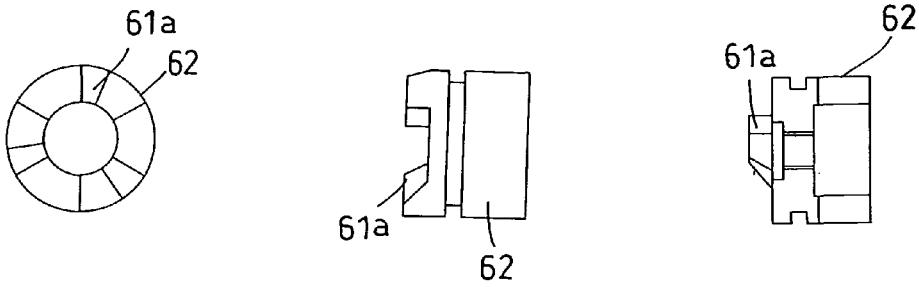
Figure 7:
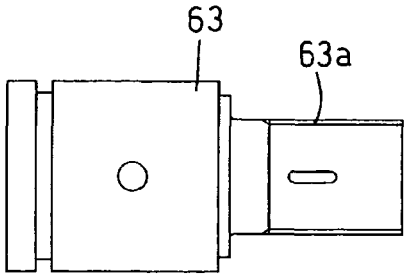
FIG. 7 (*a*) is a plan view of the cylinder, FIG. 7 (*b*) is a front sectional view, FIG. 7 (*c*) is a left side view, and FIG. 7 (*d*) is a right side view.
Figure 7:
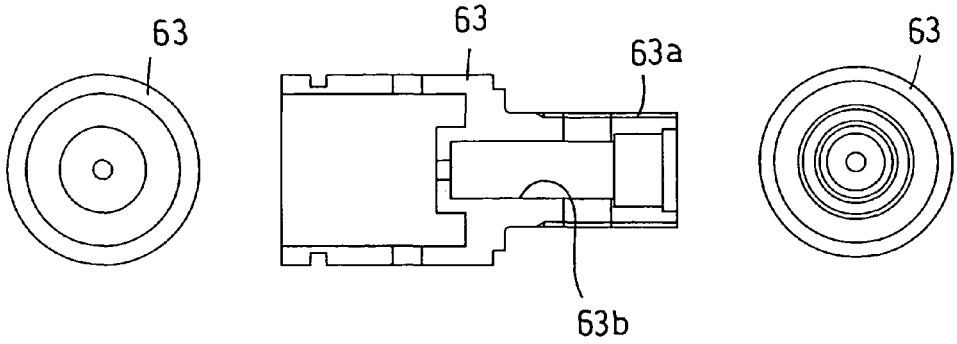
Figure 8:
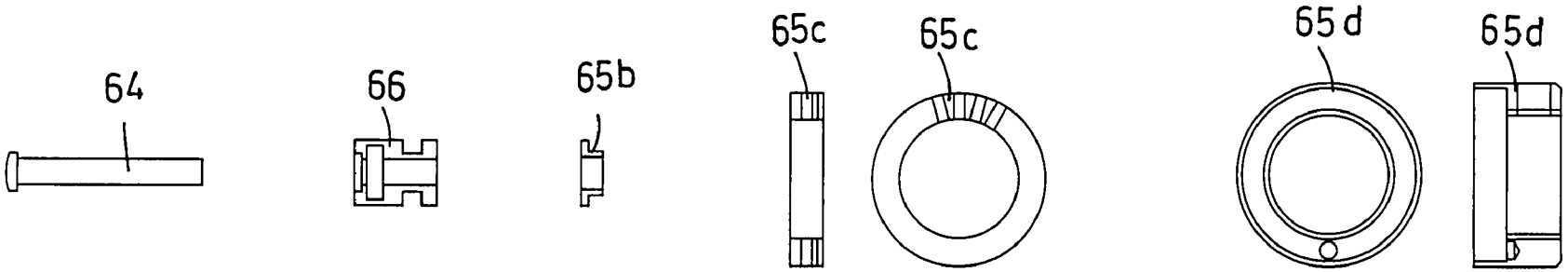
FIG. 8 is an explanatory drawing of the constituent members.

This air driver device is constructed by forming, on the downstream side of the valve 2 disposed in an air supply channel 8, an air motor side flow channel 9*a* communicating with the air motor 3, and a detecting side flow channel 9*b* communicating with a pressure detecting means (not illustrated), as shown in FIG. 2 and FIG. 4, in the same way as in the patent literature 2, disposing a plug 10 for closing only the air motor side flow channel 9*a*, by means of the torque control mechanism 6 and the shut-off valve mechanism 7, when the push rod 4 retreats, located on the tip side of the push rod 4, and slidably placing a push pipe 11 on the push rod 4, so as to maintain the valve 2 in open state when inwardly pushing the spindle 1 through the push pipe 11.

To be more concrete, the push rod 4 is slidably inserted in a slide bar 12 through which the plug 10 is slidably provided.

A push piece 13 for pressing the plug 10 from inside is placed on the slide bar 12.

This enables the push rod 4 to keep the plug 10 in an open state through the push piece 13.

On the other hand, the push pipe 11 is disposed in such a way to contact an edge of the slide bar 12 in order to open the valve 2 by moving the slide bar 12 with pressing of this edge part.

At that time, since the push piece 13 is placed on the slide bar 12, the push pipe 11 can open the valve 2 by putting the plug 10 in closed state without allowing the plug 10 to act on the push piece 13.

This makes it possible to apply a high-pressure air to the detecting side flow channel 9*b*, when stopping the air motor 3 by making the push rod 4 retreat. This enables the number of times of tightening of bolts, etc. to be accurately counted by recognizing (the number of times of) shut-off.

In this air driver device, the main part of the tightening torque control mechanism 6 is constituted, as shown in FIG. 2, FIG. 3 and FIG. 5 to FIG. 8, by a clutch unit 61, a driving piston 62 on the back face of which is formed a clutch plate 61*a* on one side so that the clutch plates 61*a*, 61*b* of the clutch unit 61 may move by making rotational differential motions, relatively, in a case where the tightening torque reaches the set torque value. This air driver also includes a cylinder 63 for storing this driving piston 62, a check valve 64 for operating the shut-off valve mechanism 7, in linkage with the driving piston 62 through an oil charged in the cylinder 63, and a torque control member 65 for regulating the set torque value.

In this case, the other clutch plate 61*b* of the clutch unit 61 is formed on the back face of the spindle 1.

Moreover, the torque control member 65 is composed of a torque adjusting spring 65*a* for urging the check valve 64, a spring support 65*b*, a detent 65*c*, a rotation adjusting member 65*d* and a locking spring 65*e*, making it possible to adjust the urging force of the torque adjusting spring 65*a* for urging the check valve 64 (i.e., the set torque value) by operating the rotation adjusting member 65*d*, fastened to the male screw formed on the outer circumferential face of the storing unit 63*a* of the check valve 64 provided in extension in the rear part of the rotary cylinder 63, from outside through the air driver device body K.

On the check valve 64 an inertial force absorbing piston 66 is slidably disposed, the inertial force absorbing piston 66 is slidable in the axial direction of the check valve 64, so that the urging force of the torque adjusting spring 65*a* may act through this inertial force absorbing piston 66 on the check valve 64, and that the oil of the cylinder 63 may be temporarily stored in the auxiliary cylinder 63*b* storing the inertial force absorbing piston 66.

This makes it possible to perform engagement and disengagement of the clutch unit 61 smoothly, and prevent any excessive tightening of the screw members due to the inertial force produced at the time of working the shut-off valve mechanism 7. This enables to perform accurate tightening with prescribed tightening force.

Figure 9:
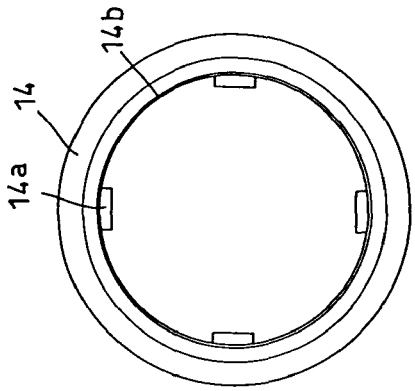
FIG. 9 (*a*) is a front sectional view of the grip, FIG. 9 (*b*) is a left side view, and FIG. 9 (*c*) is a right side view.
Figure 9:
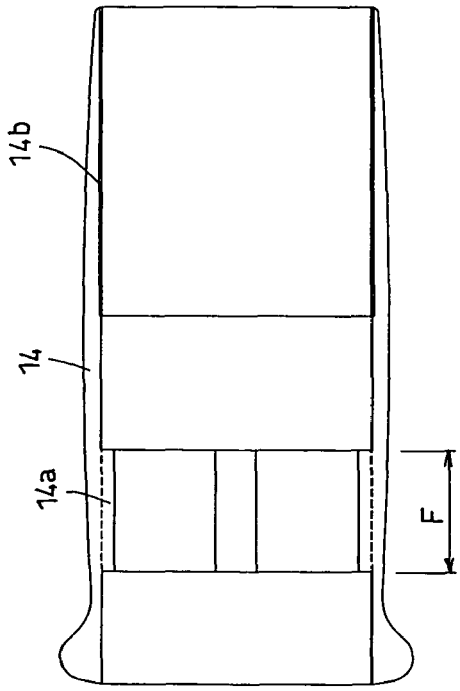
Figure 9:
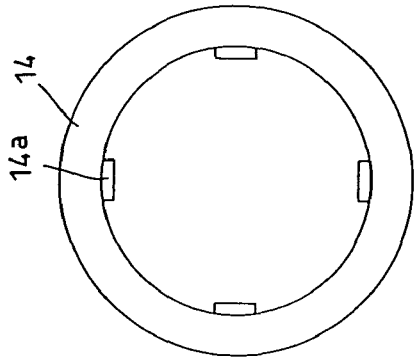

At the outer circumference of the air driver device body K is disposed, as shown in FIG. 1, FIG. 2 and FIG. 9, a grip 14 for absorbing reaction force in a way to cover the outer circumferential face of the air driver device body K.

This grip 14 is formed with a flexible material such as synthetic resin, rubber, etc., and the grip 14 and the air driver device body K are partially fixed at a part in the axial direction of the grip 14.

Here, the fixing of the grip 14 and the air driver device body K is made, though not particularly restricted, by fitting the fitting portion (fitting convexity) 14*a* formed on the inner circumferential face of the grip 14 to the fitting portion (fitting concavity) Ka formed on the inner circumferential face of the air driver device body K, for example, and by also fixing this part, as required, by using an adhesive, etc.

This makes it possible to absorb the reaction force transmitted from the fixing portion F of the grip 14 to the grip 14, as the non-fixed portion (right side of fixing portion F in FIG. 9 (*a*)) of the grip 14 is twisted, and to lessen the reaction force transmitted from the air driver device body K to the worker by three-dimensionally dispersing it.

The length of the fixing portion F of the grip 14 is set, though not particularly restricted, at 10%-40%, preferably at 15%-30% or so, of the overall length of the grip 14, depending on strength of fixing portion F of the grip 14, the magnitude of the supposed reaction force absorbed with twisting of the non-fixed portion of the grip 14, etc.

Furthermore, as material forming the grip body, soft gelatinous silicon resin or urethane resin may be suitably used.

This makes it possible to further mitigate the reaction force transmitted from the air driver device body K to the worker.

Still more, an isolating member 146 may be disposed on the inner circumferential face of the non-fixed portion of the grip 14, wherein the isolating member 14*b* is capable of mitigating the frictional resistance with the outer circumferential face of the air driver device body K.

In that case, the isolating member 14*b* shall preferably be disposed across the non-fixed portion of the grip 14 formed at about the same length as the length of the fixed portion F of the grip 14, and against the fixed portion F of the grip 14.

This isolating member 14*b* may be made by suitably using a cylindrical body made of synthetic resin such as rigid polyolefinic resin, etc. or metal such as iron, aluminum, etc., rather than the material forming the grip body. The isolating member 14*b* may be integrally formed, as shape material, at the time of forming of the grip body.

This makes it possible to prevent the non-fixed portion of the grip 14 from being restrained to the outer circumferential face of the air driver device body K by a frictional resistance, and allow twisting of the non-fixed portion of the grip 14.

Next, an explanation will be given regarding the actions of this air driver device.

Figure 10:
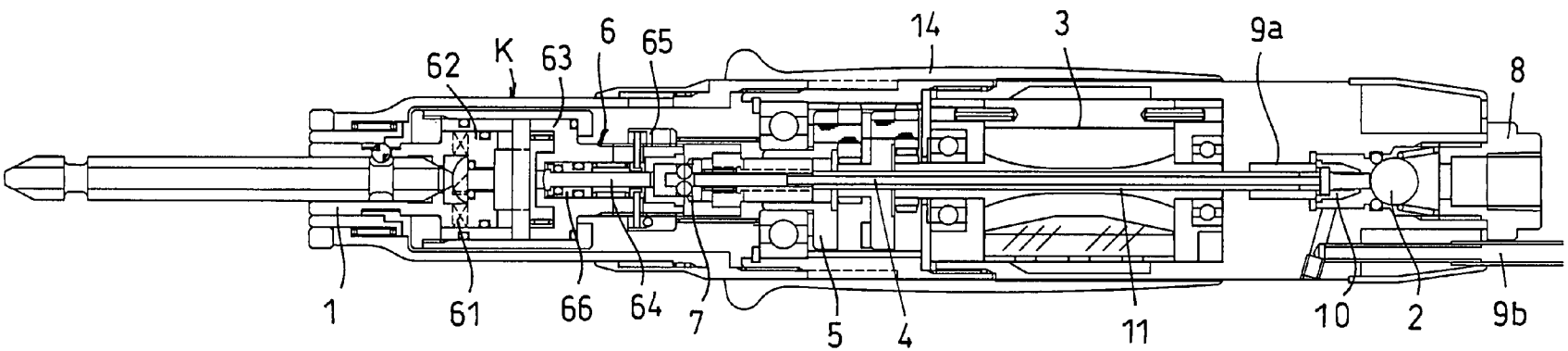
FIG. 10 is a sectional view before starting the air driver device.
Figure 11:
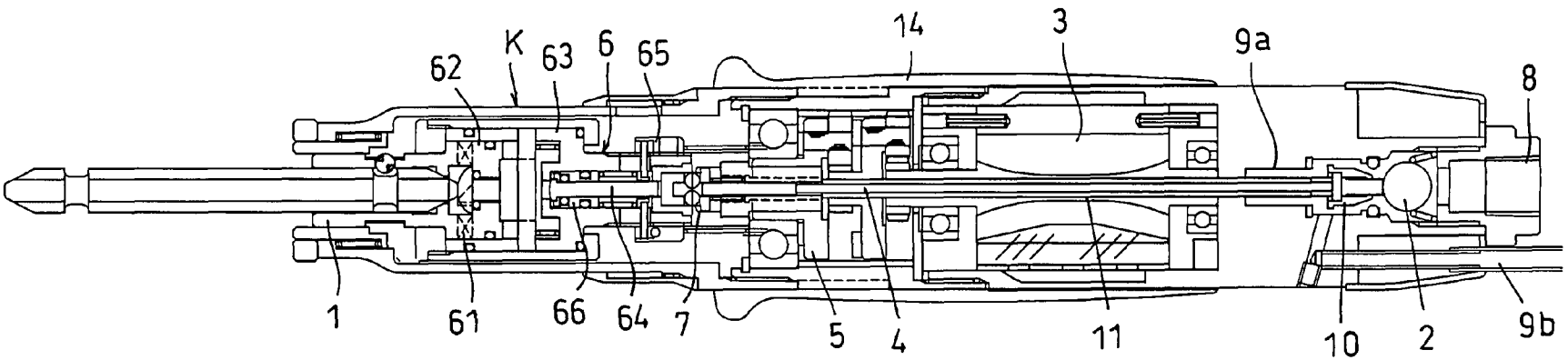
FIG. 11 is a sectional view during tightening of the air driver device.

If, in the case of tightening of bolts & nuts or screws, etc., an attachment is loaded at the tip of the spindle 1, and the spindle 1 is pushed in the axial direction from the state of FIG. 10, operation is made in such a way that the valve 2 opens through the push rod 4, etc., as shown in FIG. 11, and high-pressure air is supplied from a compressor to the air motor 3. As a result, the air motor 3 turns in a prescribed direction, and the tightening torque control mechanism 6 turns through the speed-reducing drive unit 5.

In the tightening torque control mechanism 6, the turning force is transmitted to the spindle 1, through the cylinder 63, the through the shaft of cylinder 63*c*, the driving piston 62, and the clutch unit 61.

And, the spindle 1 retreats under a pressing force, during the tightening, to enable desired tightening.

Figure 12:
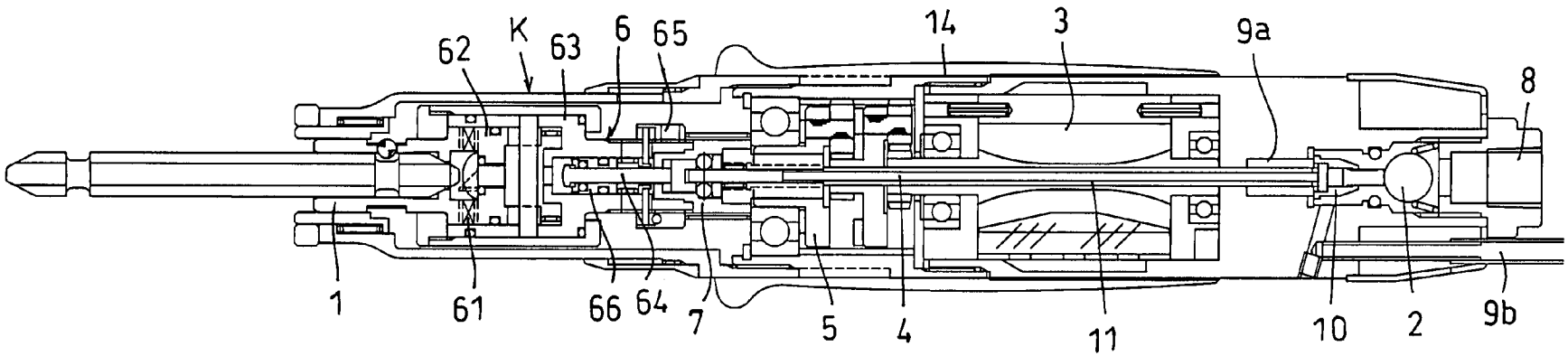
FIG. 12 is a sectional view during a shut-off of the air driver device.

As the tightening progresses and the tightening torque reaches the prescribed tightening force, which is the set torque value stipulated by adjusting the torque adjusting member 65 in advance, the clutch plates 61*a* and 61*b* of the clutch 61 make a differential rotational motion, relatively, in resistance to the urging force of the torque adjusting spring 65*a* urging the check valve 64, as shown in FIG. 12. Further, the driving piston 62 moves in the axial direction, to actuate the driving piston 64 through the oil charged in the cylinder 63, and operate the shut-off valve mechanism 7.

As a result, the push rod 4 retreats to close the plug 10, and stop the air motor 3.

At that time, because the push pipe 11 holds the valve 2 in an open state, through the slide bar 12, with the subsequent pushing in of the spindle 1, it becomes possible to make the detecting side flow channel 9*b* act on the pressure detecting means (not illustrated) by supplying high-pressure air, thus, enabling the number of times of tightening of bolts, etc. to be counted by recognizing the number of times of shut-off.

After the completion of tightening, a stop of the inward pushing causes the spindle 1, the push pipe 11, and the slide bar 12 to retreat (return to the tip side), closing the valve 2, and causes the torque control mechanism 6 and the shut-off valve mechanism 7 return to their initial positions and to get ready for the next tightening.

In addition, in this air driver device, the grip body of the grip 14 for absorbing reaction force is disposed in such a way as to cover the outer circumferential face of the air driver device body K which is formed with a flexible material, and the grip 14 and the air driver device body K are partially fixed at a part in the axial direction of the grip 14. This makes it possible to absorb the reaction force transmitted from the fixing portion F to the grip 14, with twisting of the non-fixed portion of the grip 14. Thus, enabling the reaction force transmitted from the air driver device body K to the worker to be lessened.

So far, the air driver device according to the present invention has been explained based on an embodiment. However, the present invention is not restricted to the construction described in the above-mentioned embodiment, but may be changed in construction as required within the range not deviating from the purpose of the invention.

The air driver device according to the present invention, which is simple in construction and easily realizable in compact size, can be used suitably for an application of an air driver device used in an assembly line of various types of electric machinery, etc.)

The invention claimed is:

1. An air driver device for tightening screw members at a prescribed tightening force and for shutting off a supply of compressed air when a tightening torque has reached a set torque value, said air driver device comprising:

an air motor for receiving the supply of compressed air;

a shut-off valve mechanism; and a tightening torque control mechanism for operating said shut-off valve mechanism to shut off the supply of compressed air to said air motor, wherein said tightening torque control mechanism includes:

a clutch unit having a first clutch plate and a second clutch plate engaged with said first clutch plate;

a driving piston having said first clutch plate formed on a back face thereof so that, when the tightening torque has reached the set torque value, (i) said first clutch plate and said second clutch plate are capable of rotating at different rates with respect to one another and (ii) said driving piston moves in an axial direction;

a cylinder for storing said driving piston and having oil filled therein;

a check valve linked to said driving piston through the oil filled in the cylinder, said check valve arranged to move in an axial direction in conjunction with said driving piston and for operating said shut-off valve mechanism to shut off the supply of compressed air when the tightening torque has reached the set torque value and said driving piston and said check valve move in an axial direction through the oil filled in said cylinder; and a torque control member for regulating the set torque value.

2. An air driver device according to claim 1, wherein (i) an auxiliary cylinder stores an inertial force absorbing piston and (ii) the inertial force absorbing piston, which is movable in the axial direction of the check valve, is disposed on said check valve so that an urging force of a spring constituting said torque control member acts, through said inertial force absorbing piston, on said check valve and enables said auxiliary cylinder to temporarily store the oil.

3. An air driver device according to claim 1, wherein said driving piston is moved in the axial direction by a force generated in the axial direction by said first clutch plate and said second clutch plate when the tightening torque has reached the set torque valve and said first clutch plate and said second clutch plate rotate at different rates with respect to one another.

* * * * *